United States Patent [19]

Kannwischer

[11] Patent Number: 4,829,645

[45] Date of Patent: May 16, 1989

[54] OSCILLATING ROLLER

[75] Inventor: Kurt R. Kannwischer, Lithonia, Ga.

[73] Assignee: HH&L Co., Stone Mountain, Ga.

[21] Appl. No.: 43,164

[22] Filed: Apr. 27, 1987

[51] Int. Cl.[4] ..... B21B 27/00

[52] U.S. Cl. ..... 29/123; 29/129; 29/130; 101/348; 226/190; 226/194

[58] Field of Search ..... 29/116 AD, 116 R, 118, 29/119, 123, 129, 129.5, 130; 101/148, 348, 349, DIG. 14; 226/190, 194

[56] References Cited

U.S. PATENT DOCUMENTS

| | | | |
|---|---|---|---|
| 1,040,170 | 10/1912 | Dietrich | 101/DIG. 14 |
| 1,366,925 | 2/1921 | Northrup | 101/DIG. 14 |
| 2,195,319 | 3/1940 | Sutcliffe | 226/190 |
| 2,566,449 | 9/1951 | Hornbostel | 29/116 R X |
| 2,704,392 | 3/1955 | Schultz | 29/119 X |
| 3,348,480 | 10/1967 | Bohac et al. | 101/349 |
| 3,990,391 | 11/1976 | Singh | 29/123 X |
| 4,637,109 | 1/1987 | Bryer | 29/116 AD |
| 4,718,344 | 1/1988 | Lemaster | 101/426 |

FOREIGN PATENT DOCUMENTS

| | | | |
|---|---|---|---|
| 1238489 | 4/1967 | Fed. Rep. of Germany | 101/349 |
| 2514414 | 10/1976 | Fed. Rep. of Germany | 101/DIG. 14 |
| 22949 | 1/1986 | Japan | 101/DIG. 14 |

*Primary Examiner*—Carl E. Hall
*Assistant Examiner*—Andrew E. Rawlins
*Attorney, Agent, or Firm*—Patrick F. Henry, Sr.

[57] ABSTRACT

An elongated, cylindrical metal sleeve has a soft cylindrical, elastomer cover. A shaft is mounted through the core in a bearing slip-fitted in each end and held in place by a snap ring on one end snapped into the metal sleeve and on the other end by a circular collar having a protruding tooth or dog, which is press-fitted into the metal sleeve and slides into the keyway in the shaft. A collar is fitted on each end of the shaft to limit the amount of oscillation of the roller. The ends of the shaft are mounted on a printing press in a bearing cup or some other way.

15 Claims, 1 Drawing Sheet

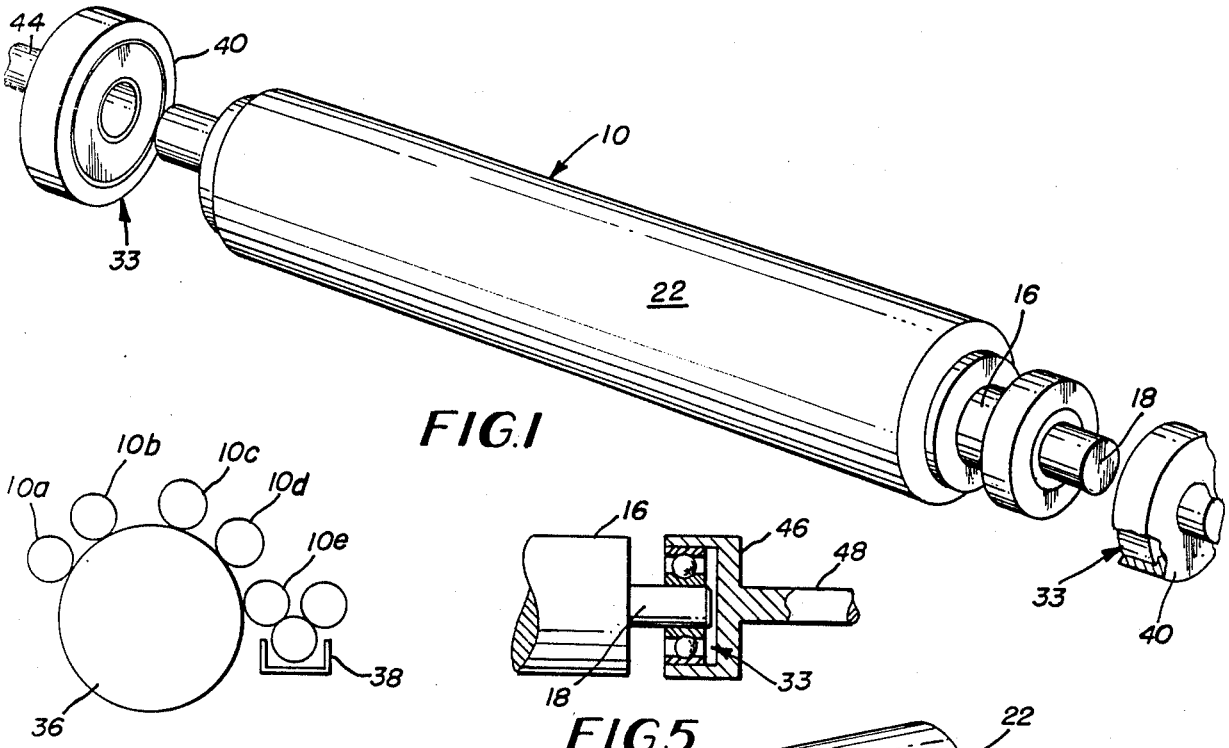
FIG.1
FIG.4
FIG.5
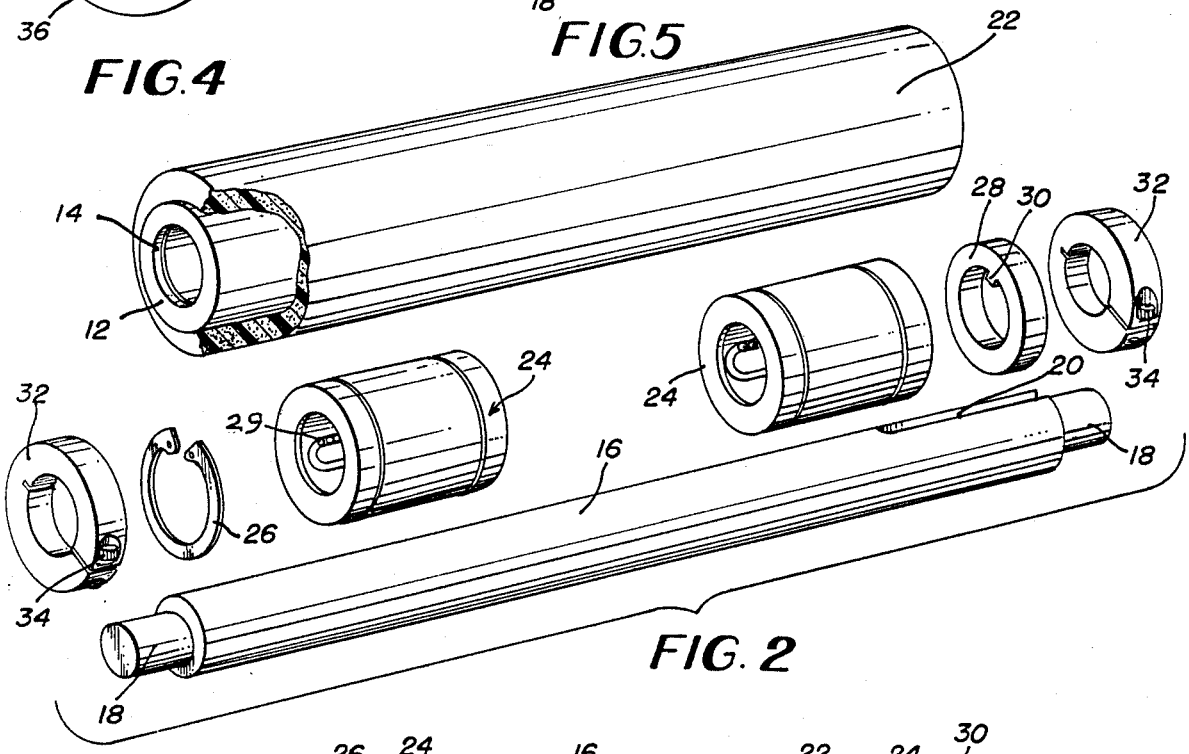
FIG. 2
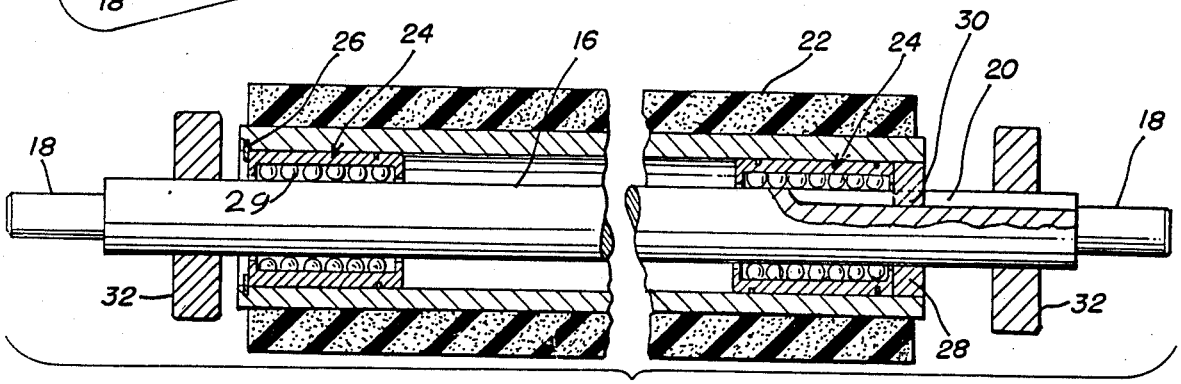
FIG. 3

OSCILLATING ROLLER

The subject matter is a roller which is mounted on a printing press or other machinery to oscillate or reciprocate in response to engagement with a printing press vibrator moving left and right on a printing press frame or some other similar machine element. The roller may be used in the graphic arts, such as on lithographic press, in the form position as the last roller down in an ink train running against the plate. Moving laterally as well as circumferentially, the present roller helps to erase the previous take-off of ink by the plate to help alleviate ghosting.

In the printing and lithographic field, as well as other machines, there is a demand for a reciprocating or oscillating roller, which moves back and forth laterally to help spread the ink, remove unwanted accumulation and help alleviate conditions known as ghosting. It is important that such a roller be freely movable, easily installed and removed, and capable of withstanding forces of movement. Prior oscillating rollers are not constructed in such a way as to provide the advantages of the present roller.

An object of the present invention is to provide an oscillating roller which can be adjusted so as not to oscillate.

Another advantage of the present roller in one particular version is the use of ball-bearings for sliding linear motion and the ball-bearings are fitted for easy removal. Ball-bearings offer much lower friction for linear moving and eliminate binding and shatter. There is less wear, low maintenance and long life.

Another advantage of the present oscillating roller resides in the use of a hard shaft as, for example, 60–65 C (scale measure used in measuring hardness on a Rockwell hardness tester). Rockwell hardness with a finish at 10 to 60 micro-inches RMC. rms (root measuring square in micro-inches for shaft smoothness and brilliance).

Another advantage of the present oscillating roller is that it can be used in the first water-form position for the Dahlgren dampening system. The Dahlgren systems do not necessarily have an oscillating roller to help reduce ghosting.

Another feature of the present roller is that the shaft may be mounted on a printing or lithographic press in either a bearing so that the shaft revolves, or in a housing which revolves about a bearing on a dead shaft or spindle on the press.

In addition, the roller may be provided with a fuzzy surface or an adhesive surface for the purpose of removing unwanted particles, sometimes called hickies, such as small spects of paper dust or dried ink or other foreign matter on the printing plate.

Other and further objects and advantages of this invention will become apparent upon reading the following description of a preferred embodiment taken in conjunction with the accompanying drawings, in which:

FIG. 1 is a perspective view of the assembled roller.

FIG. 2 is a perspective view of the disassembled roller assembly.

FIG. 3 is a medial cross-sectional view of the assembled roller shown in FIG. 1.

FIG. 4 is a diagramatic view of part of a Dahlgren system showing use of the present rollers as ghosting rollers and hicky pickers.

FIG. 5 is an end elevation view of the roller assembly mounted on an alternative cup and bearing arrangement.

DESCRIPTION OF A PREFERRED EMBODIMENT

The oscillating roller 10 comprises an elongated metal sleeve or core 12 having a longitudinal bore or central opening 14 in which is mounted a steel shaft 16 having reduced ends or journals 18 and keyway 20 on one end.

Sleeve 12 is tightly covered by a cylindrical cover 22 constructed from an elastomer, rubber compound or other suitable material. Cover 22 may also be provided with a tacky surface, such as the found in a "Bingham Hickye Pick-up", Samuel Bingham Co., 4880 Samuel Bingham Court, College Park, Ga. 30349, or sprayed with a tacky surface, such as that provided by the product "Tackit" (trademark), sold Zim Chemical Co., P.O. Box 13641, Station K, Atlanta, Ga. 30324.

Identical sleeve ball-bearing assemblies 24, such as those known as "Ball-Bushing" (trademark), produced by Thomason Industries, Inc., of Manhasset, N.Y. 10030, each is slip-fitted into the opening 14 in each end of sleeve 12 and one bearing assembly 24 is held in place by a ring retainer 26 which is placed in a groove on the inside the end of sleeve 12 outside of the bearing assembly 24 in a manner shown in FIG. 3. Each assembly 24 has circumferentially spaced rows of ball bearings 29. Ring 26 is a snap-ring which is snapped into or out of place for purposes of disassembly. The other bearing assembly 24 is held in place on the other end of the sleeve 12 by means of a removable collar 28, press fitted into sleeve 12 having a dog or tooth 30 projecting inwardly therein to fit into the keyway 20 on shaft 16 preventing the ball-bearing assemblies 24 from turning on the shaft 16 thereby forcing the shaft 16 to turn on bearing assemblies 33 located at the ends of the shaft or journal 18.

Retaining collars 32 are mounted in place on each respective end of shaft 16 by means set screws 34 which are threaded at an angle into and across a split portion through the collar 32, so that the collar 32 can be selectively tightened or loosened without the screw 34 engaging shaft 16. Collars 32 are moved towards the ends of the roller 10 to limit the amount of oscillation, or to prevent oscillation altogether and moved in the opposite direction to permit the desired amount of movement. Thus, roller 10 can be operated not only as an oscillating roller, but also as a conventional roller.

A typical assembly of rollers 10 is shown in FIG. 4 wherein the usual press plate cylinder 36 is mounted with a water form assembly 38. A pair of the rollers **10*a* and 10*b* are mounted for use as oscillating ghosting rollers and a pair of oscillating rollers 10*c*, 10*d* are mounted as oscillating hickey pickers and other rollers 10*e*** may be mounted as oscillating water form rollers in the Dahlgren system.

In FIG. 1, it is seen that the ends 18 of the shaft 16 may be provided with bearing housing cups 40 in which is mounted the ball-bearing assembly 33. Cup 40 mounted on a stub shaft 44 on the sides of the press on each end. Another mounting procedure is shown in FIG. 5 wherein the bearing assembly 33 on each end of shaft 18 is mounted in a cup 46 on the spindle 48. Accordingly, several different mountings may be used, whereby in one mounting the journal 18 rotates with bearing assembly 33 and in the version shown in FIG. 5, the spindle 48 is stationary and shaft 16 rotates with cup 46 on the bearing assembly 33.

While I have shown and described a particular embodiment of this invention, together with variations in the mounting thereof on a press, this is by way of illustration only and does not constitute any limitation on the scope of this invention, because there are various changes and departures which may be made without avoiding the scope of the invention as defined as only by proper interpretation of the appended claims.

What is claimed is:

1. In a roller device:

a roller having opposite ends and a bore therein, a bearing in each end of said roller, means for retaining said bearings removably in place within the bore of the roller, a shaft extending through said bore and said bearings and being supported for rotation with said bearings and for movement of said roller on said bearings and along said shaft, said means for retaining comprising a keyway on one end of said shaft outside said bearing on that end and a projecting member carried by said roller for travel on said shaft in said keyway whereby said roller may travel axially on said shaft while said roller and shaft travel together with said projecting member outside said bearing, and limit means on each end of said shaft for selective adjustment thereon to permit the roller and bearings to move longitudinally in both directions on said shaft thereby permitting said roller to reciprocate and oscillate in response to movement imparted to the roller whereby the roller may be used on a printing press or other machine to oscillate thereon, said roller being able to freely oscillate between said limit means.

2. The device in claim 1 wherein said roller has a cover thereon.

3. The device in claim 1 wherein each of said bearings is a sleeve bearing having ball members circumferentially therein engaged by said shaft.

4. The device in claim 3 wherein said ball members are arranged in longitudinal rows.

5. The roller claimed in claim 1 including a removable retainer, a groove in said roller for said retainer, and a collar having said projecting member thereon.

6. The device claimed in claim 1 wherein said retaining means on each end of said shaft comprises a retaining ring having a split thereon and a set screw mounted for operation across said split to tighten or loosen said ring without the screw engaging the shaft.

7. The device in claim 1 including a bearing on each end of said shaft and a bearing cup having said bearing mounted thereon.

8. The device in claim 1 including a bearing cup on each end of said shaft, a spindle on said cup, and a support bearing fitted into said cup whereby said roller rotates about said support bearing.

9. The device in claim 1 wherein there is a sleeve inside said roller and a cover on said sleeve.

10. The device in claim 8 wherein the ends of said shaft are reduced in size from the rest of the shaft.

11. In a roller device:

a roller sleeve, a cover on said sleeve, elongated bearings in each end of said sleeve having rows of ball bearings therein, a retaining member on one end of said roller for retaining said bearing removably in place within the sleeve, a second retaining member on the other end of said roller outside the bearing on that end and having a projection thereon, a shaft extending through said bearings, and said shaft having a groove receiving said projection for movement therein, said roller being movable along said shaft, roller limit means on each end of said shaft for selective adjustment thereon to permit the roller sleeve and bearings to move longitudinally in one direction and the other on said shaft thereby permitting said roller to reciprocate and oscillate in response to movement imparted to the roller cover whereby the roller may be used on a printing press or other machine to oscillate thereon for alleviating ghosting and/or removing unwanted particles, said roller being able to freely oscillate between said limit means.

12. The device claimed in claim 11 wherein said roller limit means for selective adjustment on each end of said shaft comprises a split retaining collar having a set screw mounted for operation across said collar to tighten or loosen said collar without the screw engaging the shaft.

13. The device claimed in claim 11 including bearing means for supporting said shaft for rotation on each end.

14. The device in claim 11 wherein there is a bearing on each end of said shaft and a bearing cup having the bearing mounted therein for rotation of said shaft.

15. The device in claim 11 wherein there is a bearing cup attached to each end of said shaft, a spindle on said cup, and a shaft support bearing fitted into said cup whereby said roller rotates about said support bearing.

* * * * *